United States Patent [19]

Brundiek

[11] 4,235,385

[45] Nov. 25, 1980

[54] ROLLER MILL WITH LIQUID-GAS SUSPENSION

[75] Inventor: Horst Brundiek, Neuss, Fed. Rep. of Germany

[73] Assignee: Loesche GmbH, Düsseldorf, Fed. Rep. of Germany

[21] Appl. No.: 67,740

[22] Filed: Aug. 20, 1979

[30] Foreign Application Priority Data

Sep. 6, 1978 [DE] Fed. Rep. of Germany ..... 2838782

[51] Int. Cl.[3] ..... B02C 15/04

[52] U.S. Cl. ..... 241/110; 241/117; 241/121

[58] Field of Search ..... 241/110, 117, 121, 122

[56] References Cited

U.S. PATENT DOCUMENTS

| | | | |
|---|---|---|---|
| 2,684,813 | 7/1954 | Loesche | 241/121 X |
| 2,909,330 | 10/1959 | Hardinge | 241/121 X |
| 3,591,094 | 7/1971 | Gauer | 241/121 X |
| 3,782,646 | 1/1974 | Brundiek | 241/110 |

*Primary Examiner*—Richard B. Lazarus
*Attorney, Agent, or Firm*—Holman & Stern

[57] ABSTRACT

A roller mill of the sort with a pan turning about an upright axis, a driving system under the pan and rocking levers, pushing rollers against the pan, has a roller weighting system made up of a hydraulic cylinder, pulling the levers together, and joined with an air accumulator. The cylinder is turningly supported near its center of gravity in one of the levers.

4 Claims, 6 Drawing Figures

25
22
21
24
27
28
26
19
16
15
17
18
13
9
8
7
10
6
5
4
3
12
2
14
11
1

ROLLER MILL WITH LIQUID-GAS SUSPENSION

BACKGROUND OF THE INVENTION

The invention is in respect of a roller mill with a liquid-gas, that is to say hydropneumatic, suspension system weighting the rollers, in the case of which the driving system for the grinding pan is placed under the pan. The rollers running on the grinding pan are stationarily placed, each of them being bearinged on a turnpin in a rocking lever, which is able to be rocked about an axis at its lower end so that the weighted rollers may be moved in an upright direction on running over the face of the grinding pan. The top ends of the rocking levers are joined together by a spring or suspension system, by which the grinding rollers are made to be responsible for a springing force or pressure acting on the grinding pan. In the past designs have been based on two different teachings with respect to the spring system. In the first teaching the springing effect is produced by a torsion pipe running in the cross-direction through the mill housing. In the case of the second teaching use was made of two torsion pipes which, in the case of a T-like design of the rocking lever were run out to a position on the outside of the mill housing.

Such spring systems may no longer be used with the current, ever increasing mill sizes, because the rolling forces become greater and mechanical spring designs take up overgreat amounts of space.

For meeting the needs of greater mill sizes liquid-gas roller suspension systems have been designed. More specially in the case of a liquid-gas roller suspension system there is, however, the shortcoming that the great mass of the cylinder has to be placed between the rocking levers for the purpose of having enough space for the liquid-gas connection system. On upward and downward motion of the grinding rollers, when grinding operations are taking place, the cylinders are necessarily acted upon by cross-vibrations, which are likely to be the cause of resonant vibrations and mechanical fatigue.

SHORT OVERVIEW OF THE INVENTION

One purpose of the present invention is that of making such a system design that even with a great size of the mill, the lowest possible cross-vibrations are produced. For effecting this and other purposes a system giving effect to the present invention is so designed that a liquid-power cylinder is only placed on one side of the spring system and the cylinder is turningly fixed in position on a rocking lever itself generally at the center of gravity of the cylinder. The tailpiece of the piston rod of the liquid-power, that is to say, hydraulic cylinder, is the connection between the top ends of the rocking levers and is placed running in the cross-direction through the mill housing or past the mill housing to the opposite rocking lever.

The beneficial utility, for which the invention is responsible, is to be seen in the fact that, by using a single liquid-power cylinder, the structure is made very much less complex and lower in price and, more specially, in that the mass of the hydraulic cylinder is supported outright by way of the rocking lever so that the mass of the rest of the spring system is so decreased that the vibration level is very much lower. Even with this simpler design, the liquid-air spring system makes possible liquid-power lifting of the grinding rollers, something which is of great help on starting up a mill when full of material to be processed and, for this reason, on putting an end to vibrations.

LIST OF FIGURES REPRESENTATIVE OF INVENTION

In the figures one working example of the invention is to be seen, in the case of which the connection rod between the top ends of the rocking levers is placed running through the mill housing.

FIG. 1 is a diagrammatic side view of a roller mill designed on the lines of the invention.

FIG. 1*a* is a diagrammatic section of a roller mill using broken lines for making clear the currents of material through the mill and the workings of the mill with a classifier.

DETAILED ACCOUNT OF WORKING EXAMPLE OF THE INVENTION

Figure 1:
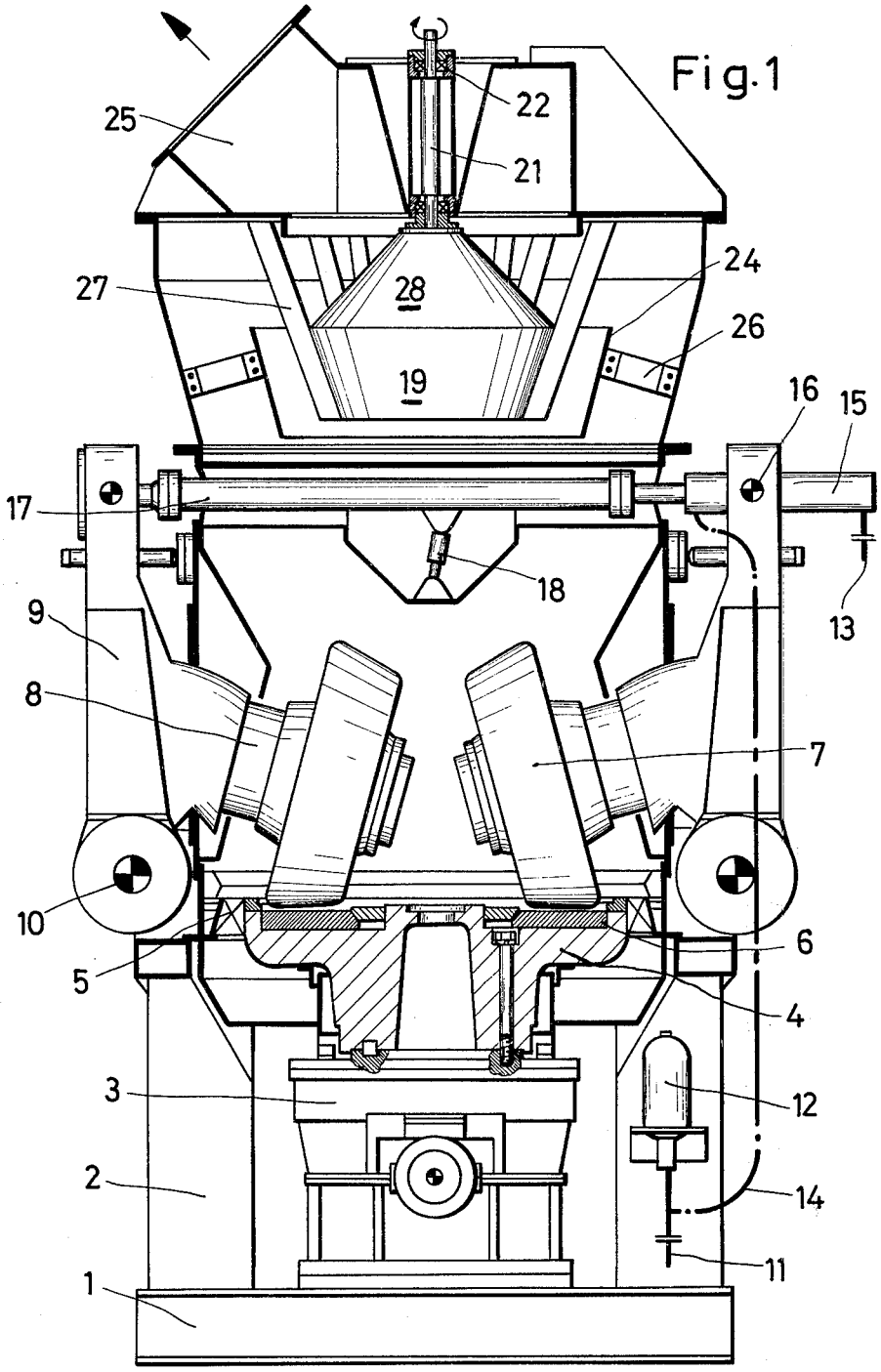

In FIG. 1 the foundation frame structure 1 is to be seen on which the roller mill is supported. For making the foundation, the roller mill is first put in position and then the concrete foundation is produced by casting round supports 2. By way of the driving system 3 and a driving shaft the grinding pan is turned, which is placed over the driving system. To the side, the grinding pan 4 has the blades 5, which are fixed together in a ring and are joined to the grinding pan 4. However, it would furthermore be possible for the blades to be placed on the housing. The blades are slopingly positioned in a way old in the art and have the purpose of causing a vortex or swirling motion of the upwardly moving gas. In the case of an air mill as currently used in industry, the gas has the function of forcing the milled material upwards, the dust parts of the milled material being so separated by a classifier placed on the mill that the small enough grains or particles may go out of the mill through the outlet 25, while the greater-size grains are dropped back into the mill, so landing on the grinding pan 4, where they are processed till small enough in size.

The wear plates 6 on the grinding pan 4 have the grinding rollers over them and, when wear has taken place, they may be taken off and exchanged for new plates. The grinding rollers 7 are run on support turnpins 8 (which are themselves supported by the rocking levers 9) as they are rolled over the face of the grinding pan 4. Each rocking lever 9 is able to be turned about its turnpin 10, so that the grinding rollers may not only be turned, but furthermore moved uprightly. At the top ends, the rocking levers 9 are joined together by a connection rod 17, turningly joined with their top ends. As will be generally seen from FIG. 1, the connection rod is in the form of a tailpiece fixed on the piston rod of the hydraulic cylinder 15. The hydraulic cylinder 15 is turningly bearinged, generally at its center of gravity, in the rocking lever 9 to be seen on the right in FIG. 1. The hydraulic cylinder 15 has the purpose of producing, by way of the rocking levers 9, a spring force on the grinding rollers 7. The hydraulic system, necessary for this purpose, is made up of the inlet line 11 for hydraulic liquid, the accumulator 12 and the inlet line 14, by which the hydraulic liquid under pressure goes to the hydraulic cylinder 15. The line 13 is used for inlet of hydraulic liquid, oil, to the cylinder 15 for lifting the rollers clear of the rolling pan in an upward direction, inlet of the liquid being at the other end of the piston. A hydraulic unit, of the necessary design and with the necessary two-way valves, is joined with the lines 11 and 13. It is not figured in detail in the drawing.

In the top part of FIG. 1 a classifier structure is to be seen having an outlet and as used in roller mills of this sort. An account is only given of the structure of the classifier to the degree necessary to make the account of the invention itself complete. In fact, the classifier figured might have its place taken by an other such classifier without the invention itself being in any way changed because of this. Inside the classifier there is an unmoving cone 24 which, by way of arms 26 is fixed to the casing of the classifier housing. Over the cone 24 centrifugal blades 27 are placed, which are fixed to cone 20, kept turning by way of a connection part 28 and the shaft 21. The shaft 21 is supported in bearings 22. The outlet for the gas current is numbered 25.

Figure 1A:
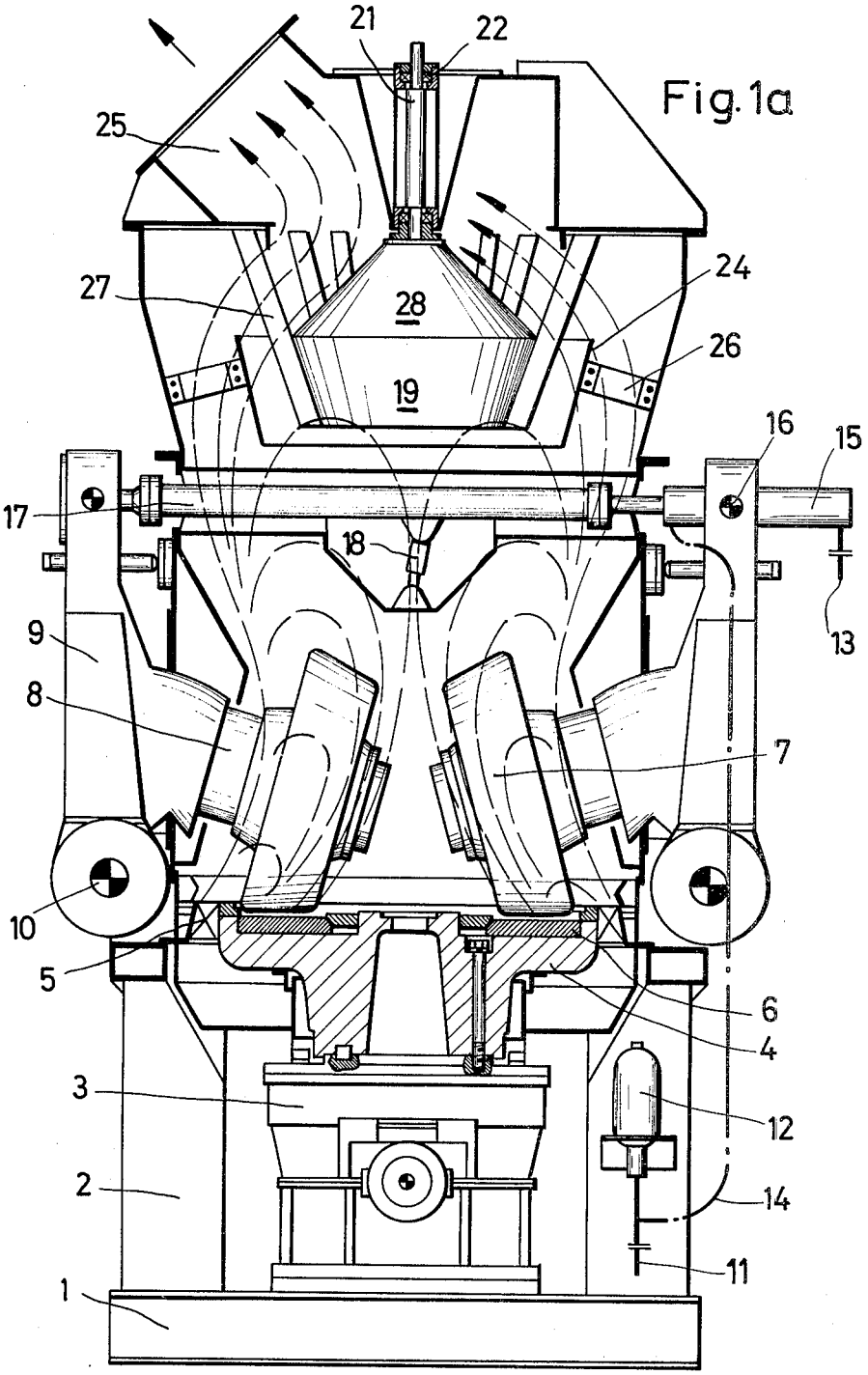

FIG. 1*a* is a diagrammatic section of a roller mill with a classifier, the part numbers being the same as used in FIG. 1. It will be seen how the current of material is firstly moved upwards at the grinding rollers 7 and then, at a certain level, becomes broader and slower so that milled material grains of a generally greater size are dropped back on to the grinding pan 4 and milled further. In the top part, that is to say in the classifier, precision classifying of the milled particles is undertaken, which go out of the plant through the outlet 25.

Figure 2:
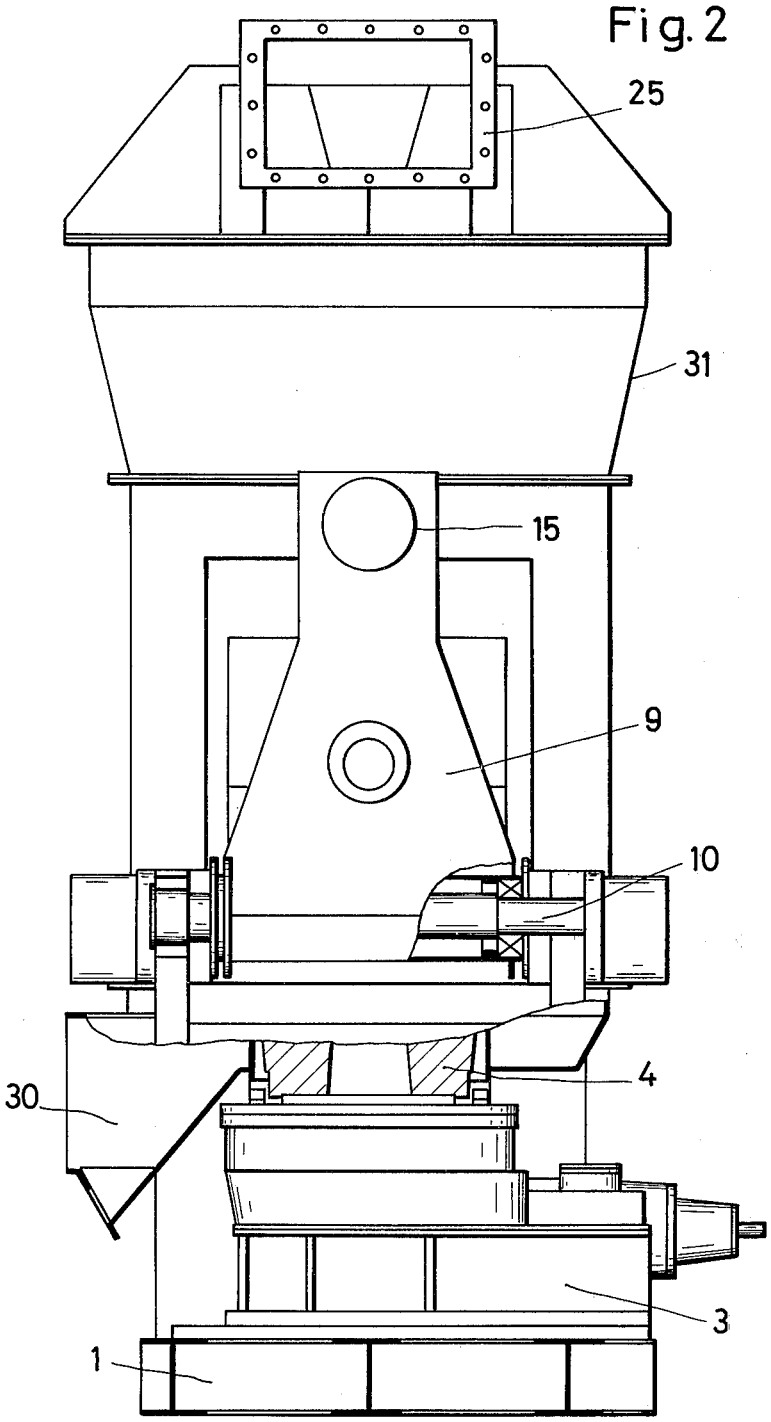
FIG. 2 is a front view.

FIG. 2 is a side view of the grinding mill, generally with the purpose of making clear the placing and design of the rocking levers 9. The plant again has a foundation frame 1 which may be in the form of concrete or steel beams. Over this foundation frame there is the driving system 3 with the driving shaft running out to the side. Over the driving system 3 the grinding pan 4 will be seen. On the left hand side of the drawing, generally at the same level as the grinding pan 4, there is the gas inlet 30, from which the gas goes through the blades 5 (to be seen in FIG. 1). Furthermore in the figure one of the rocking lever turnpins 10 will be seen, on which one of the rocking levers 9 is bearinged. For producing a trouble-free and vibration-free bearing design, the rocking levers are broadest at their positions near to the turnpins. The back end of the cylinder 15 will be seen in the top part of the rocking lever 9 (see, furthermore, FIG. 1). Above the mill the classifier with its outer housing 31 is placed. It has a gas outlet 25 in its top part.

Figure 3:
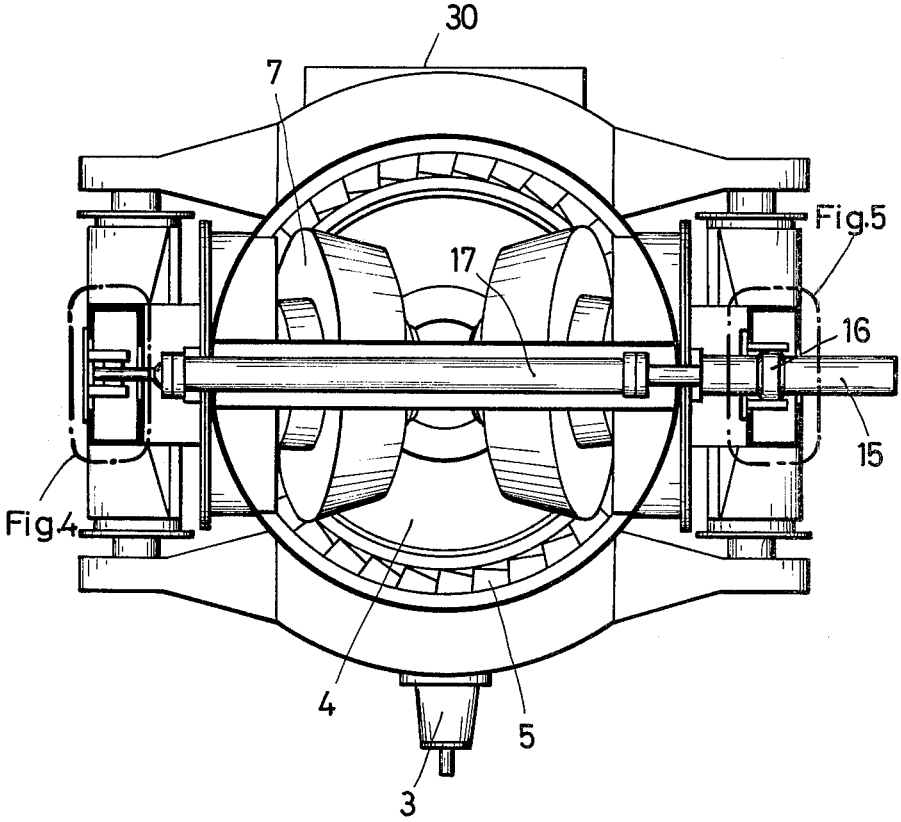
FIG. 3 is a view looking downwards.

The view of FIG. 3, looking down on the plant, makes clear not only the connection rod 17, but furthermore the positions of the grinding rollers 7. As will be more specially seen in FIG. 1, the part 17 is used for joining the top ends of the rocking levers 9 turningly. On the right hand side of the figure, the hydraulic cylinder 15 will be seen with its piston rod, whose tailpiece takes the form of the connection rod between the top ends of the rocking levers. The figure will furthermore make clear the placing of the blades 5, which are joined together in the form of a blade ring. In the lower part of the driving shaft 3 for the driving system will be seen. The opening for gas inlet will be seen in the top part of the figure.

Figure 4:
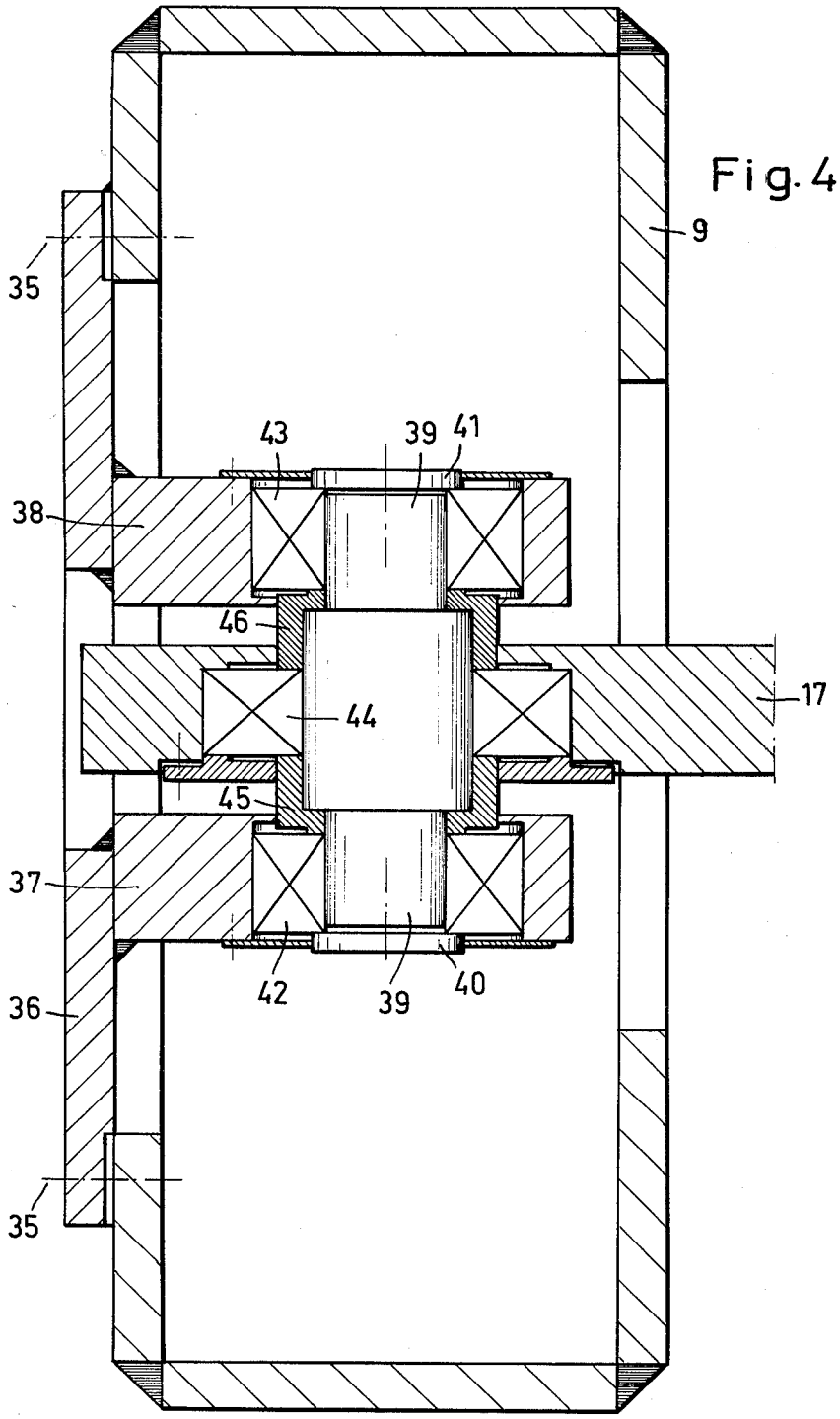
FIG. 4 is a view on a greater scale with respect to the placing of the hydraulic cylinder in the rocking lever.
Figure 5:
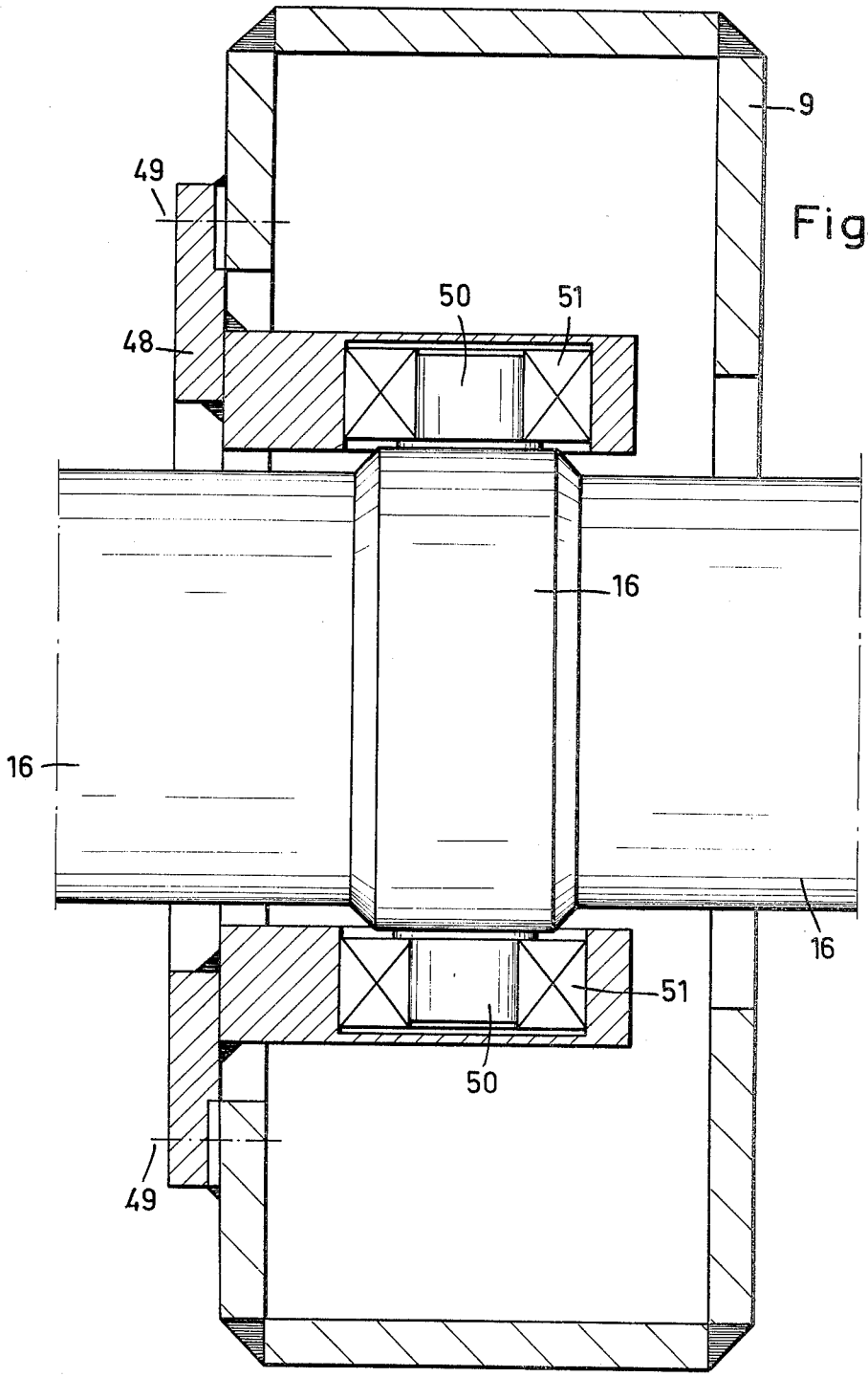
FIG. 5 is a view of details of the bearing design for the hydraulic cylinder, within the rocking lever.

In FIG. 3 some parts are framed in using broken lines, which in FIGS. 4 and 5 will be seen in more detail and on a greater scale.

FIG. 4 is a cutaway view of the rocking lever 9, which has a bearing system made up of a bearing housing 36, fixed by screws at 35 on the rocking lever 9, and bearing parts 37 and 38 acting as bearing system supports. The parts 37 and 38 are responsible for supporting the turnpin 39 by way of rolling element bearings 42 and 43. Furthermore, in the middle part a further rolling element bearing 44 is present. The bearing 44 is kept in position at the middle of turnpin 39 by spacer pipes 45 and 46. The rolling element bearings are only to be seen diagrammatically, because they are only general-purpose bearings as used regularly in mechanical engineering design, although, however, it is best for the rolling element bearings to be in the form of self-aligning bearings making possible adjustment of the rod 17 about two axes, which is joined with the bearing system 34.

In place of the self-aligning bearings which are best used in the design, it is furthermore, naturally, possible to make use of other sorts of ball-bearings, roller bearings or tapered roller bearings, to give some examples. The bearings 42 and 43 are having a cover plate 41.

FIG. 5 is a view from above and cutaway view of the rocking lever 9 to be seen in FIG. 3. A bearing housing 48 is screw-fixed on the rocking lever by screws 49. The bearing housing 48 is used for turningly supporting the hydraulic cylinder, whose position will be seen in FIGS. 1, 1*a* and 3. As will be seen from the view of FIG. 5, the hydraulic cylinder has a part 16' of increased diameter between turnpins 50, and turningly supported in the rolling element bearings 51.

I claim:

1. A roller mill having:

a grinding pan designed for turning about an upright axis, a driving system for the pan and placed under it, rocking levers, grinding rollers turningly supported on the rocking levers, the rocking levers being designed for pushing the rollers against the pan for rolling motion of the rollers on the pan and milling material on the pan, and an air-liquid or hydropneumatic system for springingly acting on the rocking levers for pulling them together with a weighting effect on the rollers, characterised in that a hydraulic suspension cylinder is placed at one side of the suspension system only and is turningly fixed, near its center of gravity, directly in a rocking lever.

2. A roller mill as claimed in claim 1, characterised in that a tailpiece, present on one side, of the piston rod of the hydraulic cylinder takes the form of a connection between the top ends of the rocking levers.

3. A roller mill as claimed in claim 2, characterised in that the connection between the top ends of the rocking levers is guided crossways through the mill housing or past the mill housing to the opposite rocking lever.

4. A roller mill as claimed in anyone of claims 1 to 3, characterised in that at the rocking levers a bearing system is placed made up of a bearing housing fixed in position by screws to the rocking lever, and furthermore having bearing parts for positioning the turnpins by way of rolling element bearings, and by way of spacer pipes a further bearing is positioned.

* * * * *